US011083653B2

(12) United States Patent
Carruthers

(10) Patent No.: US 11,083,653 B2
(45) Date of Patent: Aug. 10, 2021

(54) MEDICAL MATTRESS WITH BED PAN RECESS

(71) Applicant: Cage Brewer Carruthers, Collierville, TN (US)

(72) Inventor: Cage Brewer Carruthers, Collierville, TN (US)

( * ) Notice: Subject to any disclaimer, the term of this patent is extended or adjusted under 35 U.S.C. 154(b) by 329 days.

(21) Appl. No.: 16/083,368

(22) PCT Filed: Mar. 8, 2017

(86) PCT No.: PCT/US2017/021379
§ 371 (c)(1),
(2) Date: Sep. 7, 2018

(87) PCT Pub. No.: WO2017/156140
PCT Pub. Date: Sep. 14, 2017

(65) Prior Publication Data

US 2019/0091083 A1 Mar. 28, 2019

Related U.S. Application Data

(60) Provisional application No. 62/305,635, filed on Mar. 9, 2016.

(51) Int. Cl.
*A61G 7/02* (2006.01)
*A61G 7/057* (2006.01)

(52) U.S. Cl.
CPC ..... *A61G 7/02* (2013.01); *A61G 7/05715* (2013.01); *A61G 2203/44* (2013.01)

(58) Field of Classification Search
CPC ..... A47C 27/144; A47C 27/148; A61G 7/05723; A61G 7/065; A61G 7/01; A61G 7/05715; A61G 2203/44; A61G 9/00
See application file for complete search history.

(56) References Cited

U.S. PATENT DOCUMENTS 4,122,565 A * 10/1978 Hoben ..... A61G 7/02 5/695
4,244,066 A * 1/1981 Rukawina ..... A61G 7/02 5/691
6,061,854 A * 5/2000 Crowley ..... A47D 13/083 108/43
6,516,481 B1 * 2/2003 Erickson ..... A47C 27/144 5/723
6,802,093 B1 * 10/2004 Pope-Brown ..... A61G 7/02 5/604
7,962,980 B2 * 6/2011 Stephens ..... A61G 7/02 5/604

FOREIGN PATENT DOCUMENTS

CN 2655857 Y * 11/2004

* cited by examiner

*Primary Examiner* — David R Hare
*Assistant Examiner* — Adam C Ortiz

(57) ABSTRACT

A medical mattress for temporarily receiving a bed pan for use by a patient, comprising a mattress body of hospital grade mattress foam having a mattress cavity therein. Removable interior and exterior mattress inserts fit in the mattress cavity. The interior insert can be replaced by a bed pan. Hand grips on the interior and exterior inserts assist with removal and replacement of the inserts. Interlock fasteners are provided for temporarily securing the interior and exterior inserts in the mattress cavity for support of the patient. Methods of using and making the mattress are provided.

7 Claims, 8 Drawing Sheets

MEDICAL MATTRESS WITH BED PAN RECESS

CROSS REFERENCE TO RELATED APPLICATIONS

This application is a 35 USC 371 national stage application of PCT/2017/021379, filed Mar. 8, 2017, which is pending. PCT/2017/021379 claims the benefit of U.S. Provisional Patent Application 62/305,635, filed Mar. 9, 2016. The foregoing applications are incorporated herein by reference in their entirety.

FIELD OF THE INVENTION

The present invention relates to hospital beds, and more particularly to mattresses that have a means for temporarily receiving a bed pan for use by a patient.

BACKGROUND OF THE INVENTION

Bed pans are widely used to service patients in hospitals and long-term care facilities. While bed pans provide many benefits, they can be difficult to use. With conventional hospital beds, the bed pan must be inserted on top of the mattress surface and under the patient, which requires lifting a portion of the patient above the mattress surface. It can be difficult for health care personnel, such as certified nursing assistants, to assist weak or invalid patients in using bed pans. When patients are confined to beds permanently or for long periods of time, the problem is exacerbated. Additionally, in some cases, such as hip or spinal injuries, it is desirable to move patients as little as possible.

An alternative to bed pans is diapers. However, diapers also lead to problems, such as diaper rash and other sores and infections. In addition, the use of diapers can be quite costly, particularly for long-term care patients. Diapers also contribute to environmental waste.

Mattresses that incorporate insertable and removable bed pans are known in the art. One of the problems with conventional hospital beds that have removable sections is that construction is complex. Another problem with conventional hospital beds with removable sections is that it is not easy to remove the bed pan without lifting the patient. Numerous embodiments have been tried over the years, but apparently without commercial success.

OBJECTS AND SUMMARY OF THE INVENTION

It is an object of the invention to provide a mattress that accommodates a bed pan insert that is simple to use and economically viable in a contemporary hospital or other patient care setting.

One object of the invention is to provide a medical mattress having removable sections that can be used with conventional hospital bed frames having various sizes and features.

Another object of the invention is to provide a medical mattress having a bed pan recess that is economical to manufacture and easy to use.

The foregoing objectives are achieved by providing a mattress having the features described herein.

A medical mattress for temporarily receiving a bed pan for use by a patient is provided comprising a mattress body formed from a unibody hospital grade mattress foam. The mattress body has a first planar surface and an opposing second planar surface for supporting a patient on either side thereof. The mattress body has a mattress cavity formed therein, the mattress cavity having a back wall, and opposing side walls extending toward a front opening. The mattress cavity includes an interior portion adjacent the back wall and an exterior portion adjacent the front opening. The mattress cavity extends between the first and second planar surfaces to thereby allow the mattress to be flipped for use on either side.

A removable interior mattress insert is formed from a unibody hospital grade mattress foam. The interior mattress insert has substantially planar first and second opposing surfaces, a back face and a front face. The interior mattress insert is configured to slide into the mattress cavity and to closely fill the interior portion of the mattress cavity. The interior mattress insert sized to accommodate a bed pan upon removal of the interior mattress insert from the mattress cavity.

A removable exterior mattress insert is formed from a unibody hospital grade mattress foam. The exterior mattress insert has substantially planar first and second opposing surfaces, a back face and a front face. The exterior mattress insert is configured to slide into the mattress cavity and to closely fill the exterior portion of the mattress cavity such that together the interior and exterior mattress inserts substantially fill the mattress cavity to thereby support a patient.

An interior hand grip is fixed on the front face of the interior mattress insert for use in extracting the interior mattress insert from the mattress cavity. An exterior hand grip is fixed on the front face of the exterior mattress insert for use in extracting the exterior mattress insert from the mattress cavity. The exterior hand grip is substantially centered on the front face of the exterior mattress insert. The interior hand grip can be adjacent a first lateral side of the front face of the interior mattress insert. A first interlock fastener can be fixed on the front face of the interior mattress insert between the interior hand grip and a second opposing lateral side of the front face. A second interlock fastener can be fixed on the back face of the exterior mattress insert, the first and second interlock fasteners configured to attach to one another to thereby selectively lock the interior and exterior mattress inserts together in a substantially planar relationship for supporting a patient. A first interlock fastener can be fixed on the back wall of the mattress cavity. A second interlock fastener can be fixed on the back face of the interior mattress insert, the first and second interlock fasteners configured to attach to one another to thereby selectively lock the interior mattress insert to the mattress in a substantially planar relationship for supporting a patient. The interlock fasteners may be hook-and-loop fasteners.

Methods of use are provided, such as a method of providing a bed pan under a patient lying on a mattress for use by the patient in going to the bath room in the bed pan, including providing a mattress having the characteristics described herein, covering the mattress with a sheet while the interior and exterior mattress inserts are in the mattress cavity, and placing the patient on the mattress. When the patient is ready to use the bath room, using the exterior hand grip to slide the exterior mattress insert out of the mattress cavity from below the sheet and the patient to thereby remove the exterior mattress insert from the mattress, using the interior hand grip to slide the interior mattress insert out of the mattress cavity from below the sheet and the patient to thereby remove the exterior mattress insert from the mattress, inserting a bed pan into the interior region of the mattress cavity, the bed pan resting over the sheet and below the patient, and inserting the exterior mattress insert under the sheet and into the exterior region of the cavity such that the exterior mattress insert assists in the supporting the patient and in securing the bed pan is in the interior region of the mattress cavity. After the patient has gone to the bathroom (defecated or urinated) in the bed pan, removing the exterior insert and the bed pan from the mattress cavity, inserting the interior mattress insert under the sheet and into the interior region of the mattress cavity, and inserting the exterior mattress insert under the sheet and into the exterior region of the mattress cavity.

The foregoing and other objects, features, aspects and advantages of the invention will become more apparent from the following detailed description of the invention when considered in conjunction with the accompanying drawings.

DETAILED DESCRIPTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 2:
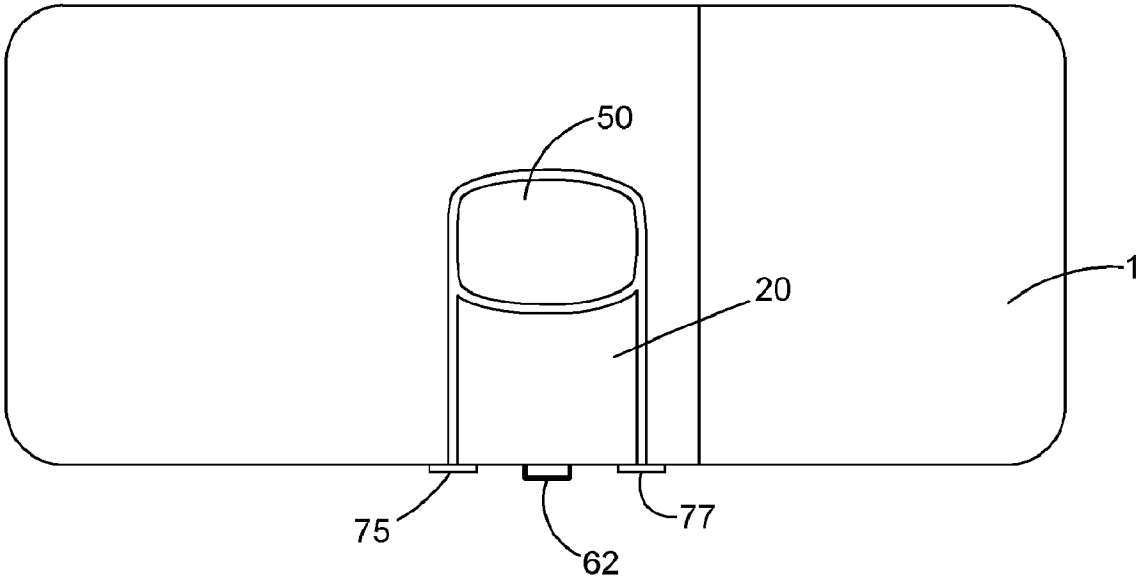
FIG. 2 is a top assembled view of one embodiment of a medical mattress for receiving a bed pan for use by a patient.

As shown in FIG. 2, the invention consists generally of a mattress 1 having a mattress cavity 2 formed therein for accommodating a removable bed pan 100. As will be described in further detail below, a removable interior mattress insert 50 and a removable exterior mattress insert 20 are configured for insertion and removal from the cavity 2. As shown, for example, in FIG. 7, the foregoing components are configured such that a bed pan 100 can be readily and temporarily substituted for the interior mattress insert 50. As described in detail below, various fastening means are provided for removably securing the mattress inserts 20, 50 in the mattress cavity 2. The mattress 1 and inserts 20, 50 are formed from conventional hospital grade mattress foam and are individually covered with a conventional fluid impermeable mattress cover material.

Figure 1:
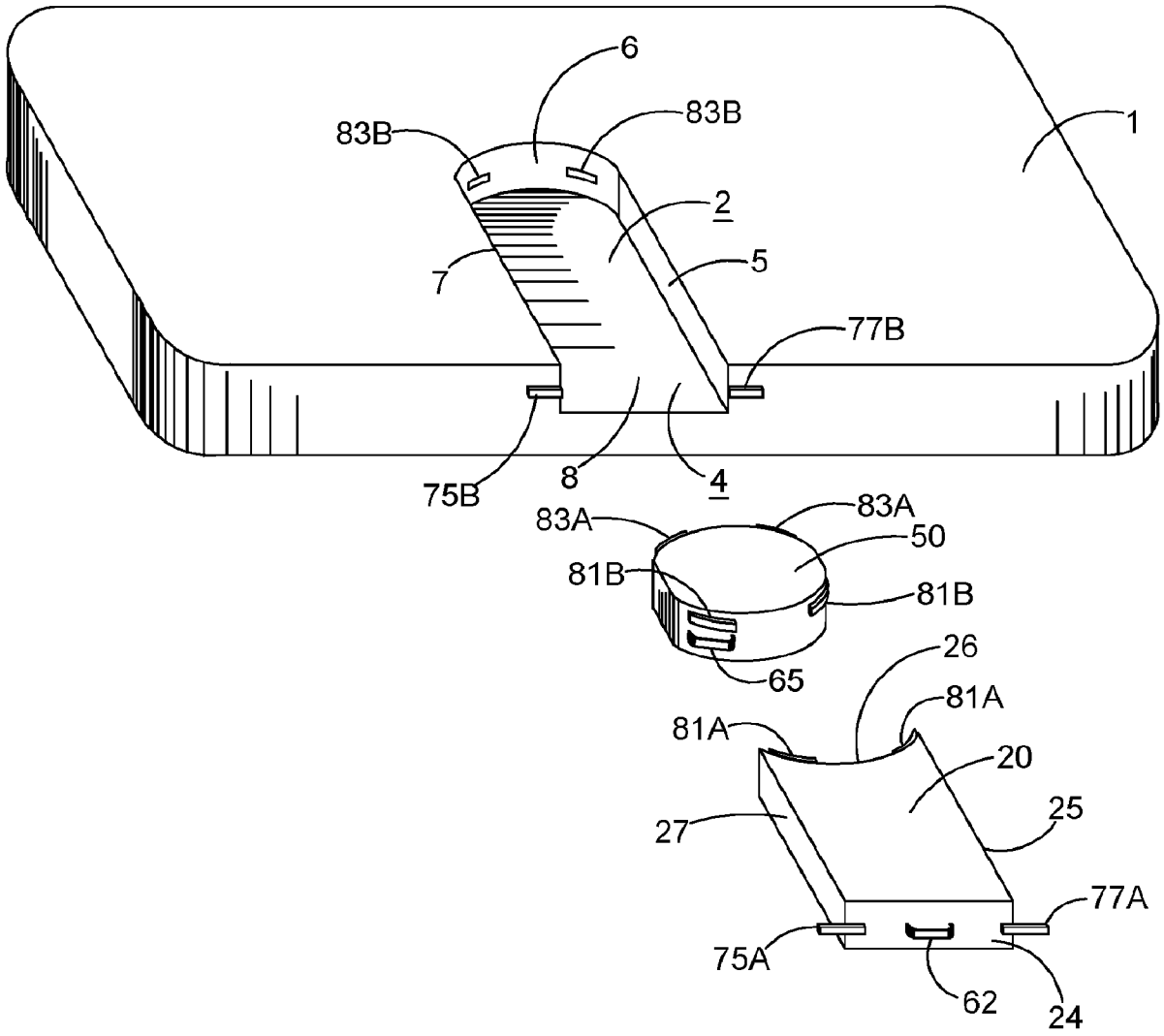
FIG. 1 is a top side perspective disassembled view of one embodiment of a medical mattress for receiving a bed pan for use by a patient.

The mattress cavity 2 is formed in or through mattress 1. As shown in FIG. 2, the cavity 2 has a front opening 4 formed along the exterior side of the mattress. Opposing sidewalls 5, 7 extend rearward from the front opening 4 to a rear wall 6. As indicated in FIGS. 1-2, the opposing side walls 5, 7 of the cavity 2 are preferably substantially flat or planar. The rear wall 6 is preferably curved or arcuate to accommodate or closely fit the outer contour of a bed pan 100.

The mattress cavity 2 may be provided with a floor 8 that spans the entire cavity 2. Alternatively, the floor 8 may extend over most but not all of the cavity 2; for example, an exterior cutout can be provided along front opening 4 to facilitate removal and insertion of the removable sections 20, 50. The floor 8 is preferably formed from the exterior cover of the mattress 1. The floor 8 provides stability to the mattress 1. The floor 8 also catches debris, such as patient waste or spillage from the bed pan 100, which protects the underlying bed frame and facilitates clean-up of mess.

Alternatively, the floor 8 can be eliminated, as shown in FIG. 9. One advantage of eliminating the floor 8 is that the mattress cavity 2 is open on both sides. This configuration allows the mattress 1 to be flipped periodically by health care personnel, such that both sides of the mattress 1 can be used. Flipping extends the useful life of the mattress 1.

Figure 9A:
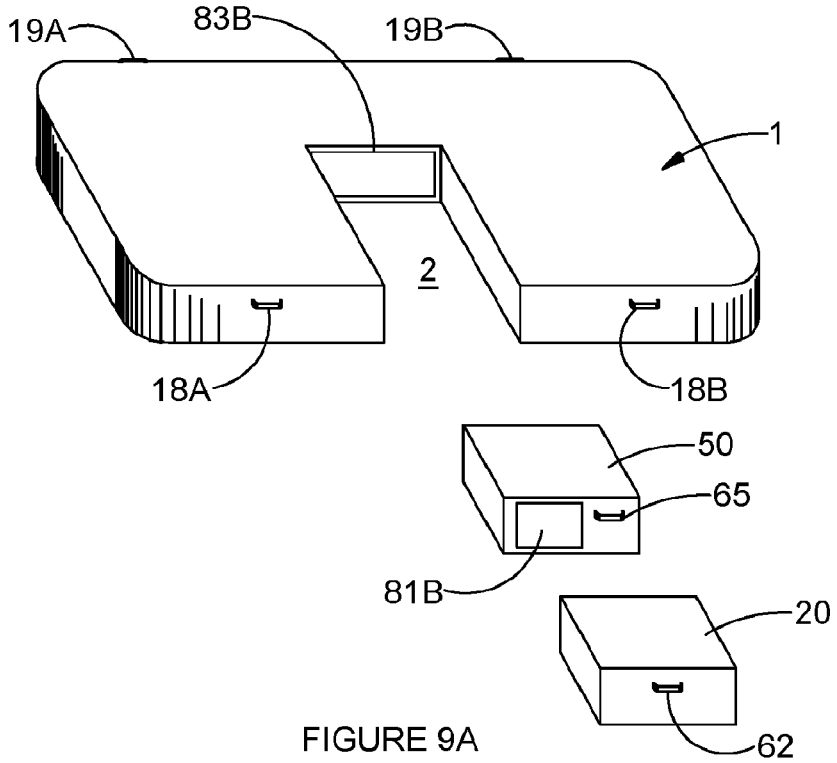
FIG. 9A is a top side perspective view of one embodiment of a medical mattress for receiving a bed pan for use by a patient featuring alternative fastener arrangements for interior and exterior mattress inserts.

FIG. 9 presents an embodiment in which the exterior mattress insert 20 and the interior mattress insert 50 are substantially centered relative to the lengthwise dimension of the mattress 1. In the configuration shown in FIG. 9, the mattress 1 can be used in four positions, which increases the life of the mattress. The mattress 1 can be flipped over, thus providing two positions. The mattress can also be rotated 180 degrees, such that exterior mattress insert 20 is on either a left side or a right side of the bed, thus providing two more positions. As shown in FIG. 9A, to assist with rotation and flipping, a pair of handles 18A, 18B, 19A, 19B is preferably provided on each of the lengthwise sides of the mattress body. FIG. 9 shows configurations in which the exterior and interior mattress inserts 20, 50 are substantially square or rectangular in profile, such as when viewed from above or below.

In some embodiments, the opposite sides of the mattress 1 can be provided with different levels of firmness (e.g. soft on one side, firm on the other). This feature reduces inventory and storage requirements, since the needs of different patients can be accommodated by flipping the mattress.

It should be noted that the embodiment having a floor 8 can be used on one side to provide the functionality of the invention, or flipped over for use as a conventional hospital bed mattress 1. The fastening features described herein enable this functionality, since the removable inserts 20, 50 remain locked in place during flipping and during use. If different levels of firmness are used on the opposing sides of the mattress 1, as described above, a plurality of mattresses 1 can be provided in which some mattresses 1 have the floor 8 on the firm side, and other mattresses 1 have the floor on the softer side.

One important advantage of the foregoing features is that they reduce inventory for the health care facility. These features also enhance the marketability of the invention. For example, a hospital that is reluctant to invest in mattresses having removable bed pan sections may nonetheless buy the mattresses 1 of the invention knowing that they can be used as conventional mattresses for short-term care patients or as removable bed pan mattresses for less self-sufficient or immobile patients.

Features of the removable mattress inserts 20, 50 will now be described.

Figure 3:
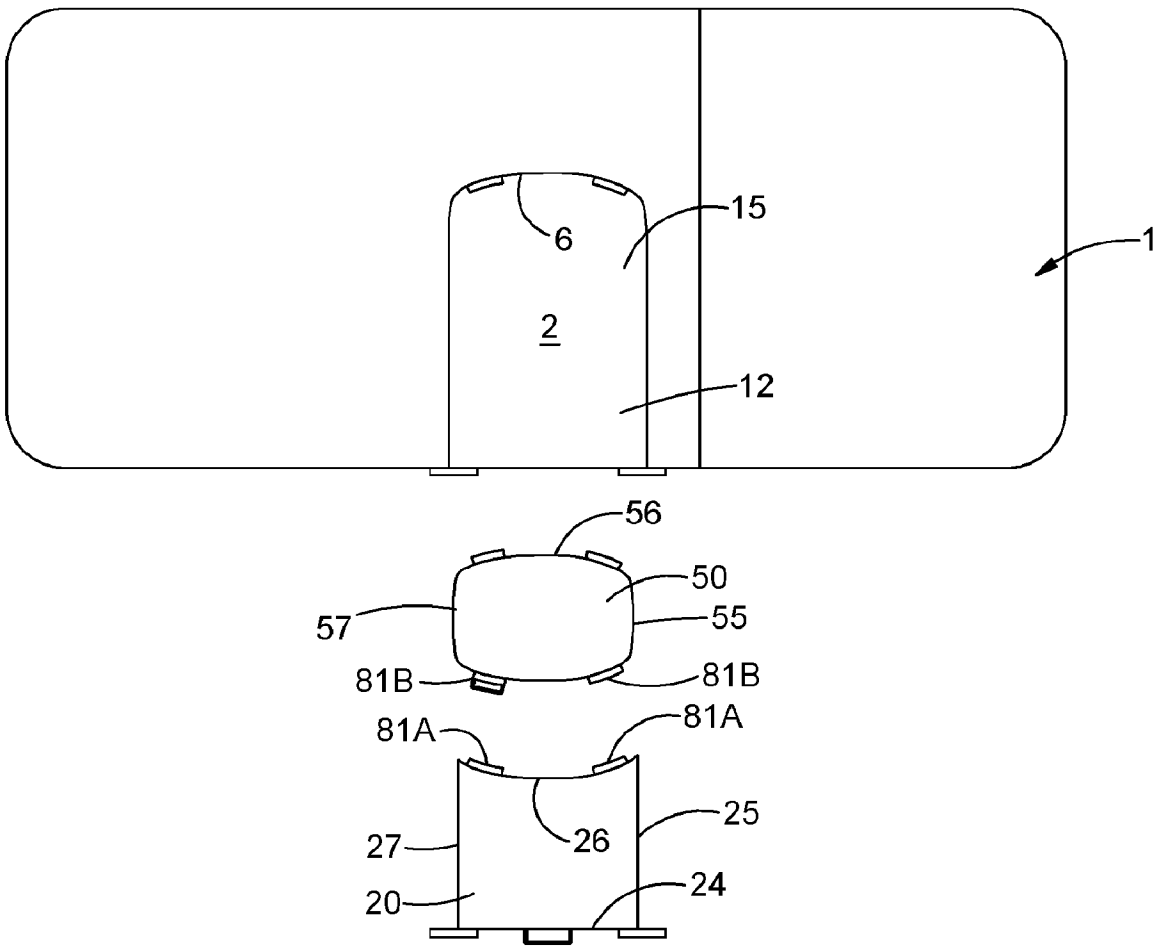
FIG. 3 is a top dissembled view of one embodiment of a medical mattress for receiving a bed pan for use by a patient.
Figure 4A:
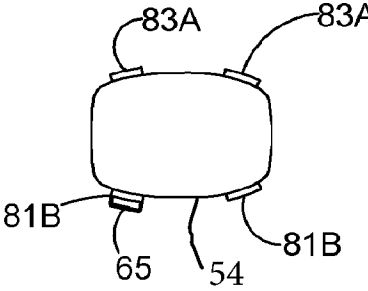
FIG. 4A is a top side view of one embodiment of an interior mattress insert for a medical mattress for receiving a bed pan for use by a patient.
Figure 4B:
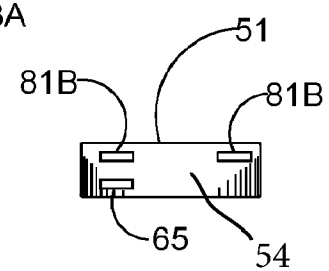
FIG. 4B is a front side view of one embodiment of an interior mattress insert for a medical mattress for receiving a bed pan for use by a patient.
Figure 4C:
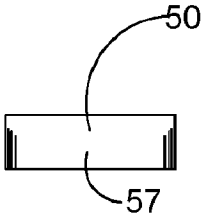
FIG. 4C is a side view of one embodiment of an interior mattress insert for a medical mattress for receiving a bed pan for use by a patient.
Figure 4D:
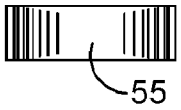
FIG. 4D is an opposing side view of one embodiment of an interior mattress insert for a medical mattress for receiving a bed pan for use by a patient.
Figure 4E:
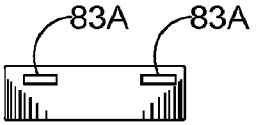
FIG. 4E is a rear side view of one embodiment of an interior mattress insert for a medical mattress for receiving a bed pan for use by a patient.
Figure 5A:
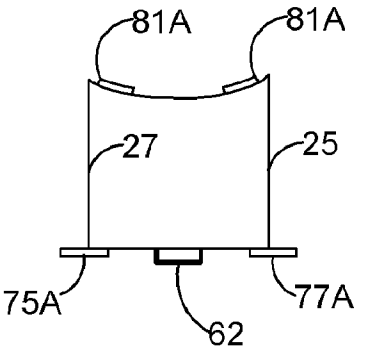
FIG. 5A is a top side view of one embodiment of an exterior mattress insert for a medical mattress for receiving a bed pan for use by a patient.
Figure 5B:
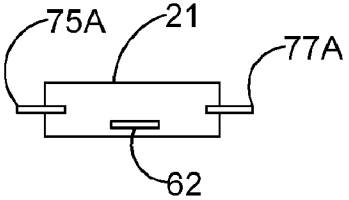
FIG. 5B is a front side view of one embodiment of an exterior mattress insert for a medical mattress for receiving a bed pan for use by a patient.
Figure 5C:
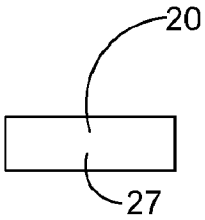
FIG. 5C is a side view of one embodiment of an exterior mattress insert for a medical mattress for receiving a bed pan for use by a patient.
Figure 5D:
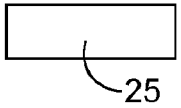
FIG. 5D is an opposing side view of one embodiment of an exterior mattress insert for a medical mattress for receiving a bed pan for use by a patient.
Figure 5E:
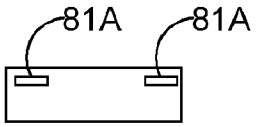
FIG. 5E is a rear view of one embodiment of an exterior mattress insert for a medical mattress for receiving a bed pan for use by a patient.

As shown, for example, in FIGS. 1 and 3, an exterior mattress insert 20 is configured to fit into an exterior region 12 of opening 2 of mattress 1. Views of one embodiment of an exterior mattress insert 20 can be seen in FIGS. 5A-5E. The exterior mattress insert 20 has a front sidewall 24, opposing sidewalls 25, 27, and a rear sidewall 26. The exterior mattress insert 20 is preferably sized to closely fit the exterior region 12, so as to substantially fill the space and support the weight of a patient. Thus, for example, the distance between opposing sidewalls 25, 27 will be slightly less than the distance between interior sidewalls 5, 7 of the mattress cavity. When thus configured, compression of the mattress by the weight of a patient will tend to retain the insert 20 in place, but not so tightly that the insert 20 cannot be slid in and out of the cavity 2 during the removal and reinsertion steps.

The exterior mattress insert 20 has a mattress surface 21. The height of the exterior mattress insert 20 is selected such that the mattress surface 21 substantially matches the height of the surface of the main mattress 1. This is important because indentations or bumps in a mattress can contribute to the development of bed sores, particularly in bedridden patients.

An exterior hand grip or handle 62 is provided on the front wall 24 of the exterior mattress insert 20 for use in extracting the exterior mattress insert 20 from the mattress cavity 20. The hand grip 62 feature is particularly useful when a patient is lying on the mattress 1, since some degree of force will be required in order to pull the exterior mattress insert from the cavity 2. The exterior handle 62 may be affixed to an exterior cover of the exterior insert 20, or may be affixed directly to the front wall 24 of the exterior mattress insert 20. The hand grip 62 is preferably flexible so that it does not protrude significantly from the mattress 1. For example, the handle is preferably made of a flexible material, such as cloth or leather. The hand grip 62 can also be used for holding the exterior mattress insert 20 during non-use, such as during insertion of the bed pan 100 into the cavity 2. The hand grip 62 can also be used for holding the exterior mattress insert 20 while reinserting the exterior mattress insert 20 back into the mattress cavity 2.

The interior mattress insert 50 of the mattress 1 shares characteristics of the exterior mattress insert 20. Views of one embodiment of an interior mattress insert 50 can be seen in FIGS. 4A-4E. The interior mattress insert 20 is configured to fit into an interior region 12 of the cavity 2 of mattress 1. The interior mattress insert 50 has a front sidewall 54, opposing sidewalls 55, 57, and a rear sidewall 56. The interior mattress insert 50 is sized and configured to closely fit the interior region 15 of the mattress cavity 2, so as to substantially fill the interior space and support the weight of a patient. In preferred embodiments, the outer contour of the interior mattress insert 50 substantially matches the outer contour and size of a bed pan 100. Generally speaking, most bed pans 100 have a standard size and shape. However, it will be appreciated that different forms and sizes of bed pans may be in use in a particular health care facility, and therefore that in some cases, the interior mattress insert 50 may not substantially match the size and shape of a given bed pan 100.

The interior mattress insert 50 has a mattress surface 51. As with the exterior mattress insert 20, the height of the interior mattress insert 50 is selected such that the mattress surface 51 of the interior mattress insert 50 substantially matches the height of the surface of the main mattress 1. Thus, together, the mattress 1 and mattress inserts 20, 50 form a substantially uniform surface. This is important because indentations or bumps in a mattress can contribute to the development of bed sores, particularly in bedridden patients.

A hand grip or handle 65 is preferably provide on the front wall 54 of interior mattress insert 50. The hand grip may be positioned on one side or the other of the front wall 54. The hand grip 65 is preferably collapsible, so that a buldge is not created by the hand grip 65 when the exterior and interior mattress inserts 20, 50 are joined together. The hand grip 65 can be formed of the same materials and configurations as the hand grip 62 of the exterior mattress insert 20. As noted in FIG. 4A-4B, it may be desirable to orient the hand grip 62 on one side or the other of the front wall 54, rather than in the middle.

Various releasable fastening or retaining means will now be described. As noted above, the fastening or retaining means are critical to the functionality and advantages of the invention.

As shown, for example, in FIG. 3, a first buckle fastener 75 is positioned on first side of the exterior mattress insert 20, while a second buckle fastener 77 is positioned on a second side of exterior mattress insert 20. While various types of fasteners could be used to provide first buckle fastener 75, key features are a strong, quick connect fastener that preferably is simple to use and inexpensive. Plastic, snap-together fasteners of the type that are currently used, for example, on lifejackets provide an ideal buckle fastener 75 for the invention. Such fasteners lock when snapped together but readily unlock simply by depressing locking tabs and pulling the components apart.

It will be appreciated that each buckle fastener 75, 77 consists of two parts (75A/75B, 77A/77B), one of which is affixed to the exterior mattress insert 20 and the other of which is affixed to the mattress 1 at or adjacent the front opening 4. As shown in FIG. 2, a first part 75A of first buckle fastener 75 is affixed on or adjacent to a first edge of the front wall 24 of the exterior mattress insert 20. A second part 75B of the first buckle fastener 75 is affixed to the mattress 1 on or adjacent to the first edge of the front opening 4 of mattress cavity 2. Likewise, a first part 77A of the second buckle fastener 77 is affixed on or adjacent to a second edge of the front wall 24 of the exterior mattress insert 20. A second part 77B of second buckle fastener 77 is affixed to the mattress 1 on or adjacent a second edge of the front opening 4 of the mattress cavity 2.

Readily releasable interlock fastening means are used to releasably secure the mattress inserts 20, 50 in the mattress cavity 2. Interlock fasteners interlock when pressed together and disengage to open when a sufficient counter vialing force is applied. Hook-and-loop fasteners (sold, for example, under the trademark VELCRO®) are ideal for this application, particularly when joining curved or arcuate mattress sections. However, other interlock means, such as snaps or magnets, could be used.

In the embodiment shown most clearly in FIG. 3, first interlock fasteners 81 are provided in the junction between the rear wall 26 of the exterior mattress insert 20 and the front wall 54 of the interior mattress insert 50. As further shown in the embodiment of FIG. 3, second interlock fasteners 83 are provided in the junction between the rear wall 56 of the interior mattress insert 50 and the rear wall 6 of the mattress cavity 2. Each first interlock fastener consists of a first part 81A that is affixed to the rear wall 26 of the exterior mattress insert 20 and a second part 81B that is affixed to the front wall 54 of the interior mattress insert. The first and second parts 83A, 83B of the second interlock fasteners 83 are positioned likewise on the respective walls 56, 6 forming the interior insert/mattress junction. As can be appreciated from FIG. 3, when hook-and-loop fasteners are used, pressing the exterior and interior sections 20, 50 together causes the first hook-and-loop components 81A, 81B to interlock and thus hold the sections 20, 50 together. Similarly, pushing the interior mattress insert 50 against the mattress 1 causes the first hook-and-loop components 83A, 83B to interlock and thus hold the interior mattress insert 50 on the mattress 1.

Figure 9B:
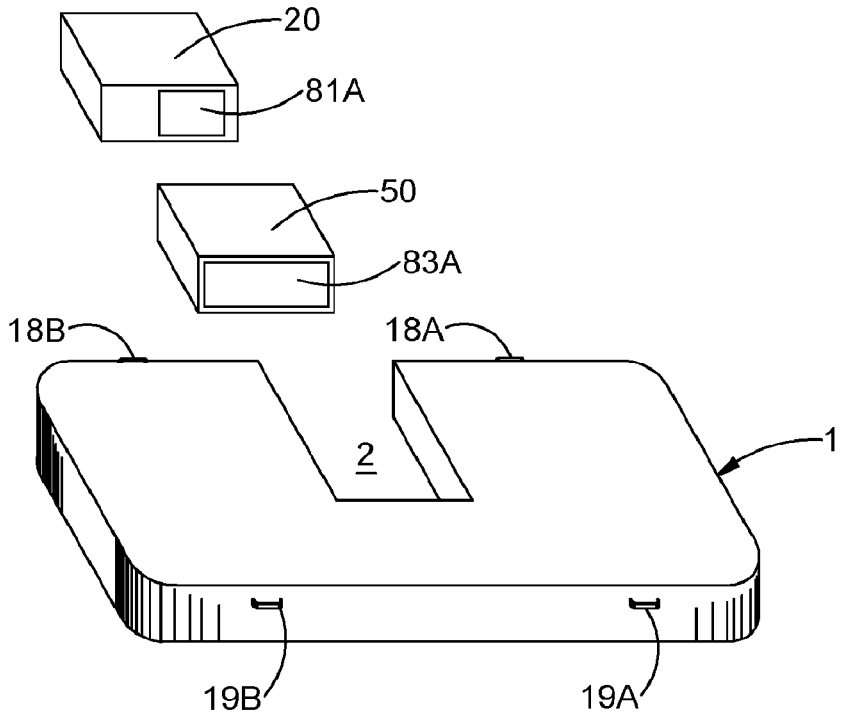
FIG. 9B is a top rear perspective view of one embodiment of a medical mattress for receiving a bed pan for use by a patient featuring alternative fastener arrangements for interior and exterior mattress inserts.

In FIGS. 9A and 9B, the first interlock fastener 81 comprises a large strip of hook-and-loop faster 81A affixed to the rear wall of the exterior mattress insert 20 and a large strip of hook-and-loop fastener attached to the front face of the interior mattress insert 50. Similarly, the second interlock fastener 83 comprises a large strip of hook-and-loop faster 83A affixed to the rear wall 56 of the interior mattress insert 50 and a large strip of hook-and-loop 83B fastener affixed to the rear wall 6 of the cavity 2. Due to the presence of the handle 65, the first interlock fastener 81 is not as large as the second interlock fastener 83. These large strips can take the place of buckle fasteners 75, or can be supplemented with buckle fasteners 75. The large version of the strips can be about 1.5 to 2.5 inches wide, with 2 inches being perhaps ideal.

While the hook-and-loop fasteners are shown in pairs and horizontally oriented in the drawings, it will be appreciated that different configurations and placements could be used. For example, variations might include a single long strip, one or more wide strips, three short strips, four short strips, multiple vertical strips, etc. The objective is to provide sufficient force to retain the removable sections 20, 50 in the mattress cavity 2 during normal use by a patient, but not so much force that the mattress inserts 20, 50 are difficult to remove from the mattress 1. Additionally, using a minimally appropriate amount of hook-and-look fasteners will improve the economics of mattress manufacture.

The placement of the hook-and-loop fasteners is important to the function of the invention. As will be noted from the drawings, the hook-and-loop fasteners are not provided along the sidewalls of the cavity 2 and removable sections 20, 50, because such an arrangement would make it difficult to remove and reinsert the removable sections 20, 50. However, placement of hook-and-loop fasteners on or along the rear wall 6 of the cavity/rear wall 56 of interior insert 50 and on or along the front wall 54 of interior insert 50/rear wall 26 of exterior insert 20 helps anchor the removable sections 20, 50, preventing them from inadvertently slipping from the mattress cavity 2.

The bed pan 100 is configured to closely fit the rear portion 15 of the mattress cavity 2. A customized bed pan 100 can be configured for the rear portion 15, but since an objective of the invention is to minimize costs, the bed pan 100 is preferably an off-the-shelf bed pan 100. However, the construction of the mattress allows it to be readily customized to closely fit a particular bed pan configuration.

While dimensions will vary, it is anticipated that for most applications of the invention, the exterior insertion section 20 and the interior insertion section 50 will each extend approximately $\frac{1}{3}^{rd}$ of the width of the mattress 1, or, together, about ⅔rds of the width of the mattress 1. For most bed pans 100 currently on the market, an opening of about 14½" long and 12 inches wide is needed in the center of the mattress in order to accommodate the bed pan 100.

Figure 8:
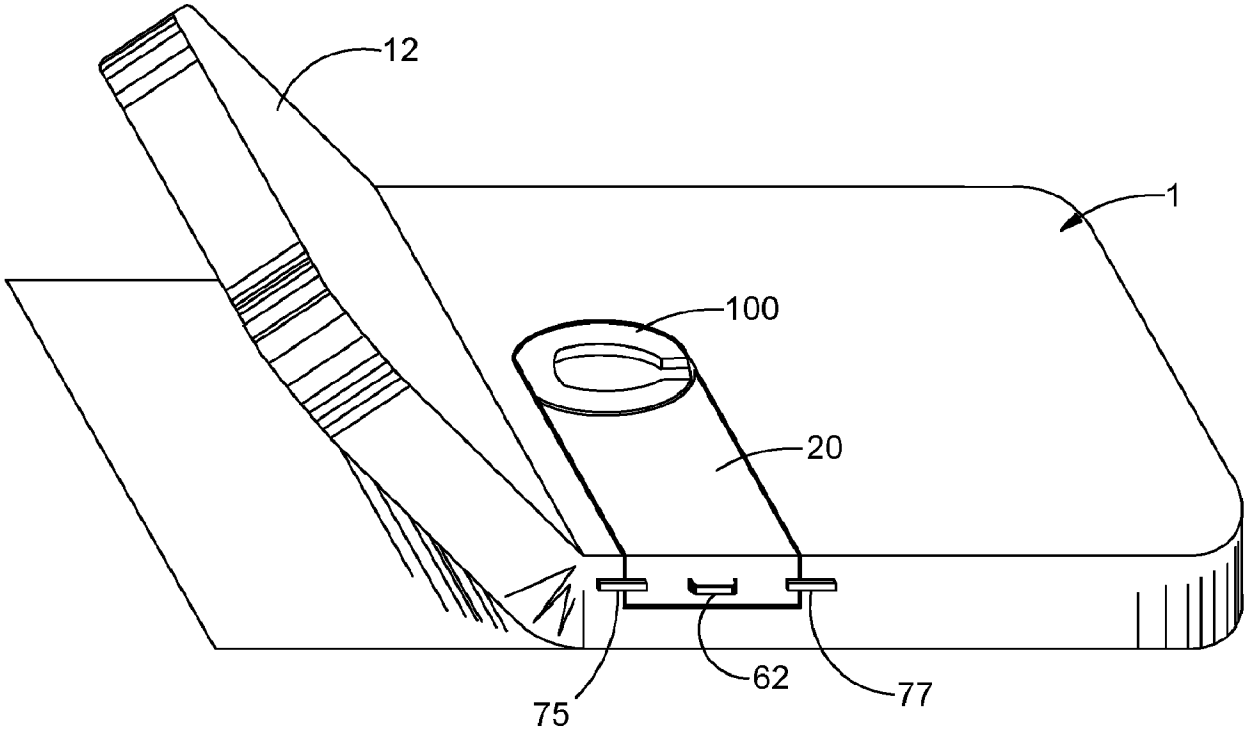
FIG. 8 is a top side perspective view of one embodiment of a medical mattress for receiving a bed pan for use by a patient, featuring removable sections located along a location where the mattress angles or folds.

As shown in FIG. 8, in one embodiment, the removable sections 20, 50 are made or placed at approximately along the location where the mattress angles or folds when the bed frame tilts the mattress up in an isometric position.

Each removable section 20, 50 preferably has its own fully covered surface, preferably covered with the same material as the main mattress 1.

A standard hospital mattress is currently about 80 inches long by 35 inches wide by 5 inches thick. However, the embodiments described herein can be used with various sizes of mattresses.

Figure 6:
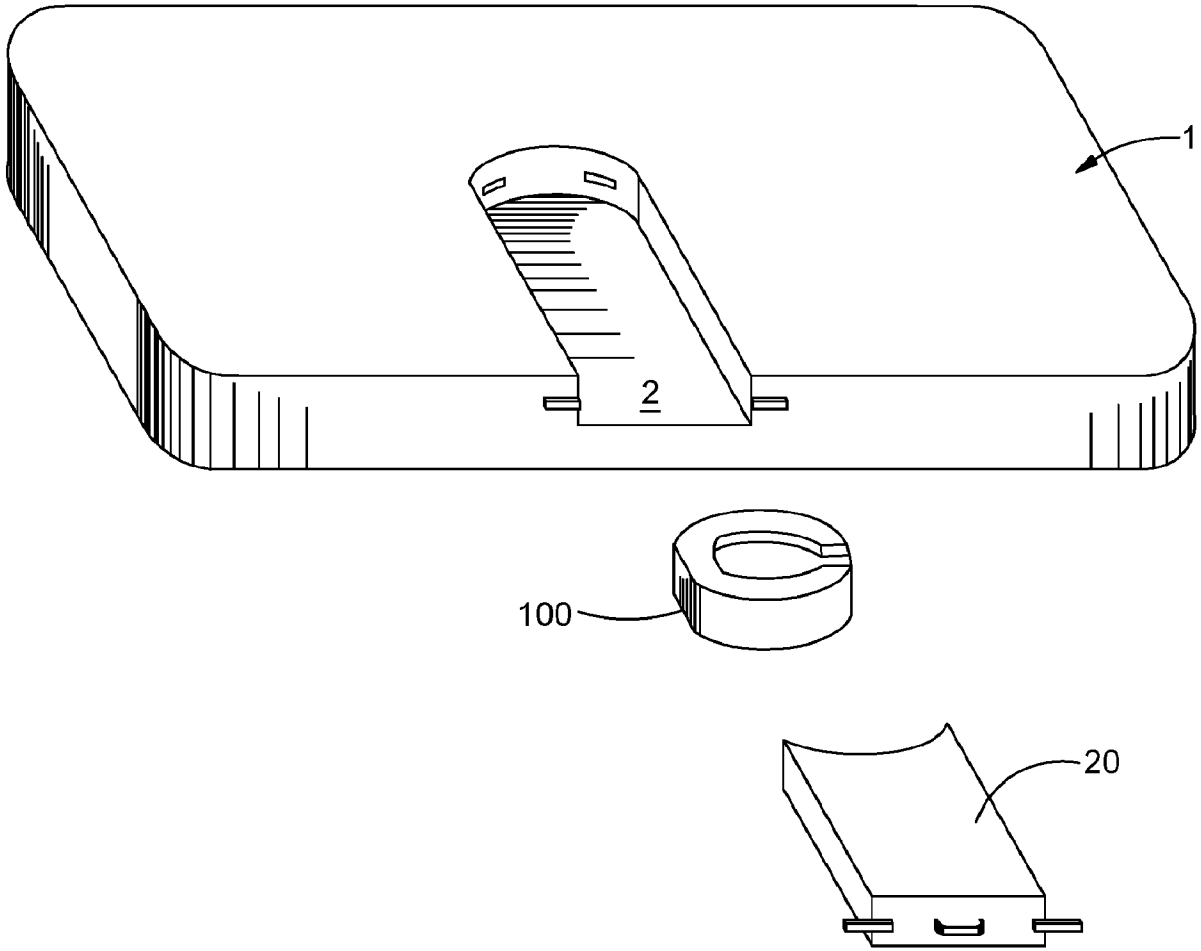
FIG. 6 is a top side perspective dissembled view of one embodiment of insertion of a bed pan and an exterior mattress insert into a medical mattress for receiving a bed pan for use by a patient.
Figure 7:
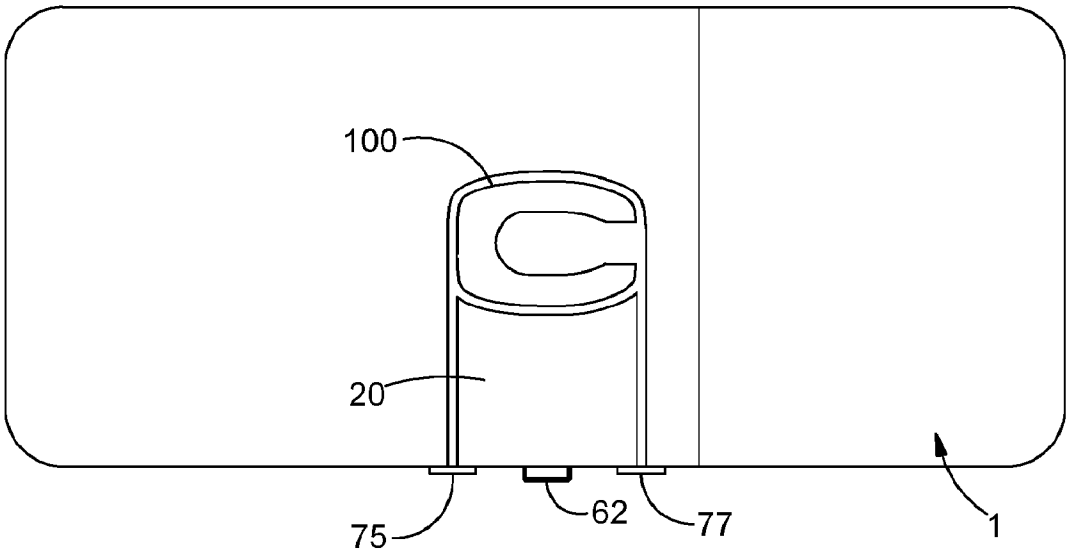
FIG. 7 is a top assembled view of one embodiment of a bed pan and an exterior mattress insert in a medical mattress for receiving a bed pan for use by a patient.

Methods of removing and reinserting the removable sections 20, 50 are indicated in FIGS. 1-3. Methods of replacing interior mattress insert 50 with a bed pan 100 and replacing the exterior mattress insert 20 adjacent to the bed pan 100 are indicated in FIGS. 6-7.

In one method, the exterior mattress insert 20 is removed, the interior mattress insert 50 is removed, and a bed pan 100 is inserted below the patient and into the interior region 15 of the cavity 2. Once the bed pan 100 is in place, the exterior mattress insert 20 is then reinserted into exterior region 12 of the cavity 2, such that the exterior mattress insert 20 provides support for the body of the patient and also secures the location of the bed pan 100. In these operations, the bed pan 100 may be placed over the bed sheet, such that the bed sheet is compressed into the cavity 2. The exterior mattress insert 20 is inserted under the bed sheet, such that the surface of the bed sheet is restored to the patient, with the exception of the area occupied by the bed pan 100. Once the process is complete, the exterior insert 20 and the bed pan 100 are removed, the interior mattress insert 50 is reinserted under the sheet, and the exterior mattress insert 20 is reinserted under the sheet, thus restoring the surface of the mattress 1. The use of interlock fasteners, as described above, in the interior of the cavity 2 facilitates the removal, reinsertion, and securing of the inserts 20, 50.

These methods are superior and better for the patient because they reduce or eliminate discomfort and pain. The patient does not have to roll over, get lifted up, or balance on or over the bed pan. The caregiver's work tasks are simplified and safer, since there is little or no lifting of the patient. The process greatly reduces costs in many ways while also reducing waste (eliminate diapers; fewer accidents with resulting reduction in laundry).

A method of making or manufacturing the mattress 1 is also provided. Most contemporary hospital beds are made of a unibody foam mattress body. Unlike many home mattresses, springs are not incorporated into the interior of the mattress. The foam mattress body is then enveloped or encased in a thin, flexible cover that is impermeable to fluids and is easy to clean. In one method of manufacturing the invention, the starting point is a conventional foam mattress body prior to applying the cover material. A jigsaw or other cutting means is used to cut the insert section 20/50 from the mattress body, thus forming the mattress cavity 2. A jigsaw is then used to cut the curved or arcuate junction between between the exterior and interior insert sections 20, 50. This forms three separate sections, which are then each encased in the conventional mattress coating described above. Further, if a floor 8 is to be provided for the mattress cavity 2, the floor 8 is preferably formed from the outer coating material during the encasing process. The upper surface casing is pressed down along the interior walls 5, 6, 7 and is adjoined to the floor 8 in order to form a junction that is impermeable to fluids. The various fasteners and handles are then affixed in the appropriate locations, as described above. Alternatively, the three sections can be formed from separate sections of foam, but this will result in waste foam. The above described process reduces waste and can be accomplished in an efficient manufacturing process.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A method of providing a bed pan under a patient lying on a mattress for use by the patient in going to the bath room in the bed pan, comprising:

providing a mattress, the mattress comprising a mattress body formed from a unibody hospital grade mattress foam, the mattress body having a first planar surface and an opposing second planar surface for supporting a patient on either side thereof, the mattress body having a mattress cavity formed therein, the mattress cavity having a back wall, opposing side walls extending toward a front opening, the mattress cavity including an interior portion adjacent the back wall and an exterior portion adjacent the front opening, the mattress cavity extending between the first and second planar surfaces to thereby allow the mattress to be flipped for use on either side, a removable interior mattress insert formed from a unibody hospital grade mattress foam, the interior mattress insert having substantially planar first and second opposing surfaces, a back face and a front face, and configured to slide into the mattress cavity and to closely fill the interior portion of the mattress cavity, the interior mattress insert sized to accommodate a bed pan upon removal of the interior mattress insert from the mattress cavity, a removable exterior mattress insert formed from a unibody hospital grade mattress foam, the exterior mattress insert having substantially planar first and second opposing surfaces, a back face and a front face, and configured to slide into the mattress cavity and to closely fill the exterior portion of the mattress cavity such that together the interior and exterior mattress inserts substantially fill the mattress cavity to thereby support a patient, an interior hand grip fixed on the front face of the interior mattress insert for use in extracting the interior mattress insert from the mattress cavity, and an exterior hand grip fixed on the front face of the exterior mattress insert for use in extracting the exterior mattress insert from the mattress cavity, covering the mattress with a sheet while the interior and exterior mattress inserts are in the mattress cavity, placing said patient on the mattress, when said patient is ready to use the bath room, using the exterior hand grip to slide the exterior mattress insert out of the mattress cavity from below the sheet and said patient to thereby remove the exterior mattress insert from the mattress, using the interior hand grip to slide the interior mattress insert out of the mattress cavity from below the sheet and said patient to thereby remove the exterior mattress insert from the mattress, inserting a bed pan into the interior region of the mattress cavity, the bed pan resting over the sheet and below the patient, and inserting the exterior mattress insert under the sheet and into the exterior region of the cavity such that the exterior mattress insert assists in the supporting said patient and in securing the bed pan is in the interior region of the mattress cavity.

2. The method of claim 1, further comprising, after said patient has gone to the bathroom in the bed pan, removing the exterior insert and the bed pan from the mattress cavity, inserting the interior mattress insert under the sheet and into the interior region of the mattress cavity, and inserting the exterior mattress insert under the sheet and into the exterior region of the mattress cavity.

3. The method of claim 1, wherein the sheet is compressed into the mattress cavity by the bed pan.

4. The method of claim 2, wherein the exterior hand grip is substantially centered on the front face of the exterior mattress insert.

5. The method of claim 4, wherein the interior hand grip is adjacent a first lateral side of the front face of the interior mattress insert.

6. The method of claim 5, further comprising a first interlock fastener fixed on the front face of the interior mattress insert between the interior hand grip and a second opposing lateral side of the front face, and a second interlock fastener fixed on the back face of the exterior mattress insert, the first and second interlock fasteners configured to attach to one another to thereby selectively lock the interior and exterior mattress inserts together in a substantially planar relationship for supporting a patient.

7. The method of claim 6, further comprising a third interlock fastener fixed on the back wall of the mattress cavity, and a fourth interlock fastener fixed on the back face of the interior mattress insert, the third and fourth interlock fasteners configured to attach to one another to thereby selectively lock the interior mattress insert to the mattress in a substantially planar relationship for supporting a patient.

* * * * *